US006456005B1

(12) United States Patent
Panchula et al.

(10) Patent No.: US 6,456,005 B1
(45) Date of Patent: Sep. 24, 2002

(54) MATERIALS AND METHODS FOR APPLICATION OF CONDUCTING MEMBERS ON ARC TUBES

(75) Inventors: Martin L. Panchula, University Heights; Karthik Sivaraman, Mayfield Village; Curtis Edward Scott, Mentor, all of OH (US)

(73) Assignee: General Electric Company, Schenectady, NY (US)

( * ) Notice: Subject to any disclaimer, the term of this patent is extended or adjusted under 35 U.S.C. 154(b) by 78 days.

(21) Appl. No.: 09/703,112

(22) Filed: Oct. 31, 2000

(51) Int. Cl.[7] ..... H01K 1/50
(52) U.S. Cl. ..... 313/567; 313/594; 313/607
(58) Field of Search ..... 313/567, 594, 313/601, 607, 235; 315/248

(56) References Cited

U.S. PATENT DOCUMENTS

| | | | | |
|---|---|---|---|---|
| 3,424,935 A | | 1/1969 | Gungle et al. | |
| 3,828,214 A | | 8/1974 | Keeffe et al. | 313/1 |
| 4,048,539 A | | 9/1977 | Walker et al. | 315/176 |
| 4,053,809 A | | 10/1977 | Fridrich et al. | 313/198 |
| 4,568,859 A | | 2/1986 | Houkes et al. | 315/248 |
| 4,633,135 A | | 12/1986 | Akins | 313/594 |
| 4,727,294 A | | 2/1988 | Houkes et al. | 315/248 |
| 4,788,475 A | | 11/1988 | Jacobs | 315/183 |
| 4,940,923 A | | 7/1990 | Kroontje et al. | 315/218 |
| 5,047,693 A | | 9/1991 | Roberts et al. | 315/248 |
| 5,059,868 A | | 10/1991 | El-Hamamsy et al. | 315/248 |
| 5,355,053 A | | 10/1994 | Zhu | 315/73 |
| 5,541,480 A | * | 7/1996 | Renardus et al. | 313/635 |
| 5,757,137 A | | 5/1998 | Zhu | 315/73 |
| 5,994,823 A | | 11/1999 | Okamura et al. | 313/25 |

OTHER PUBLICATIONS

Waymouth and Kusko, Monographs in Modern Electrical Technology (1971), Electric Discharge Lamps.

Nortup, Krasko and Lou, Journal of the Illuminating Engineering Society (Summer 1996), Pulse Start of Metal Halide Lamps for Improved Lumen Maintenance.

Byszewski and Budinger, Journal of the Illuminating Engineering Society (Summer 1990), Enhanced Starting of HID Lamps.

Wyner, Journal of the IES (Apr., 1979), Electrolysis of Sodium Through Alumina Arc Tubes.

Gregor, Li, Budinger and Byszewski, Journal of the Illuminating Engineering Society (Summer, 1996), Arc Tube Transparency Loss Due to Starting of HID Lamps.

Waymouth, Koury, Gungle and Peterson, Illuminating Engineering (Apr., 1967), Sodium Loss Processes in Metal Iodide Arc Lamps.

Cohen, Gungle, Gutta, Olson and Richardson, Journal of IES (Jul., 1974), Heat Starting a High–Pressure Sodium Lamp.

Collins and McVey, Lighting Design & Application (Sep., 1975), HPS Lamps for Use on HPM Ballasts.

Illuminating Engineering Society of North America Lighting Handbook, Eighth Edition, High–Intensity Discharge Lamps, p. 219.

* cited by examiner

*Primary Examiner*—Robert H. Kim
*Assistant Examiner*—Elizabeth Gemmell
(74) *Attorney, Agent, or Firm*—Fay, Sharpe, Fagan, Minnich & McKee, LLP

(57) ABSTRACT

An arc discharge lamp comprising an arc tube comprising a starting aid is provided. The starting aid comprises a coating on the surface of the arc tube. The coating is comprised of metal oxide, nitride, carbide, silicide, and mixtures thereof.

20 Claims, 1 Drawing Sheet

MATERIALS AND METHODS FOR APPLICATION OF CONDUCTING MEMBERS ON ARC TUBES

BACKGROUND OF INVENTION

Field of the Invention

The present invention relates generally to lighting, and more specifically to an arc discharge lamp, such as a ceramic metal halide lamp. This invention relates particularly to novel conducting materials and a means for applying such conducting members to high pressure arc discharge lamp tubes, e.g. sodium arc tubes (HPS).

Discharge lamps produce light by ionizing a fill such as a mixture of metal halides and mercury with an electric arc passing between two electrodes. The electrodes and the fill are sealed within a translucent or transparent discharge chamber which maintains the pressure of the energized fill material and allows the emitted light to pass through it. The fill, also known as a "dose" emits a desired spectral energy distribution in response to being excited by the electric arc. However, arc discharge lamps, particularly those of a high pressure variety, are often difficult to start.

Previous HPS starting aids have been designed in the form of a wire or coiled ignition filament. The starting aid is positioned in contact with the outer surface of the arc tube and is connected to one electrical power lead of the lamp. When an arc is formed and the lamp begins to warm up, power is either removed form the starting aid, or the starting aid is moved away from the arc tube, so as to prevent electric field accelerated sodium diffusion through the arc tube wall. Such sodium diffusion would adversely affect the lamp life. One drawback to this method for applying an external conducting member to HPS arc tubes is the cost and complexity of designing lamps with movable starting aids. Furthermore, in the absence of direct attachment to the lamp, the starting aid may sag away from the arc tube due to the high temperature of operation. Additionally, these switches are typically attached to the lamp frame, resulting in heating by radiation, rather than by conduction. This results in variation of lamp performance depending on the wattage of different lamps.

Alternative metallic starting aids for discharge lamps are composed of tungsten metal to reduce the required electrical breakdown voltage for starting. Unfortunately, they may not survive an air firing step used for cleaning ceramic arc tubes. Moreover, the tungsten oxidizes and becomes useless as a starting aid. A similar oxidation problem prevents application of metallic starting aids on arc tubes intended for open air operation, such as ceramic or quartz mercury arc tubes for light projectors. Another problem with existing metallic starting aids is that tungsten is relatively expensive. However, lower cost metals have higher vapor pressure, which in the vacuum established within the outer envelope of HPS lamps, would evaporate to produce bulb darkening and lumen reduction.

It would therefore be desirable to find a novel conducting member, and a means for applying such a conducting member to arc tubes, which would overcome the above mentioned problems.

SUMMARY OF INVENTION

The present invention relates to an arc discharge lamp comprising an arc tube including a starting aid. The starting aid comprises at least one conducting compound applied to the surface of the arc tube. The conducting compound is comprised of metal oxides, nitrides, carbides, and silicides. Particularly preferred materials include titanium nitride, silicon carbide, tungsten carbide, molybdenum silicides ($Mo_5Si_3$ and $MoSi_2$), silicon nitrides, and molybdenum carbides.

In another embodiment of the present invention, a method for forming an arc discharge lamp is provided. This method comprises applying as particles, or alternatively sputter coating, the metal oxides, nitrides, carbides, and silicides onto the surface of an arc tube.

In another embodiment of the present invention, a high pressure sodium lamp is provided. The high pressure sodium lamp includes an outer bulb; first and second discharge devices within said outer bulb connected electrically in series, each discharge device including a discharge vessel enclosing a discharge space and an ionizable filling; first and second discharge electrode assemblies within said discharge space each including an electrode portion on which a discharge arc terminates during normal lamp operation and a current conductor portion extending to the exterior of said discharge vessel; means for electrically connecting said first electrode assembly of each discharge device to a source of electric potential outside of said lamp envelope; and a starting aid including a coating on the surface of the arc tube. The coating is comprised of metal oxide, nitride, carbide, or silicide.

DETAILED DESCRIPTION OF INVENTION

Figure 1:
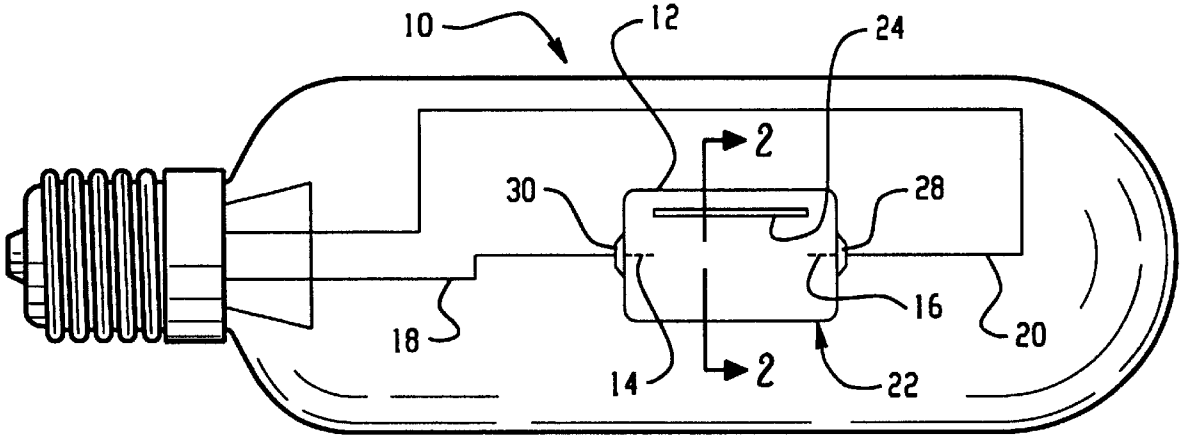
FIG. 1 illustrates a light source including a ceramic discharge chamber with a starting aid according to an exemplary embodiment of the invention.

Referring now to FIG. 1, a discharge lamp 10, such as a high pressure sodium lamp, according to an exemplary embodiment of the invention is depicted. The discharge lamp 10 includes a discharge chamber 12 which houses two electrodes 14,16 and a fill (not shown). The electrodes 14, 16 are connected to conductors 18, 20 which apply a potential difference across the electrodes. In operation, the electrodes 14,16 produce an arc which ionizes the fill in discharge chamber 12. The emission characteristics of the light produced by the plasma depend primarily on the constituents of the fill material, the voltage across the electrodes, the temperature distribution of the chamber, the pressure in the chamber, and the geometry of the chamber. For a ceramic metal halide lamp, the fill material typically comprises a mixture of mercury, a rare gas such as argon or xenon and a metal halide such as NaI, $ThI_3$, or $DyI_3$. Of course, other examples of fills are well known in the art.

As shown in FIG. 1, the discharge chamber 12 comprises a central body portion 22 with a starting aid 24 coated on the exterior. The ends of the electrodes 14,16 are typically located near the opposite ends of the body portion 22. The electrodes are connected to a power supply by the conductors 18, 20, which are disposed through each seal 28, 30. The electrodes typically comprise tungsten. The conductors typically comprise molybdenum and niobium, the latter having a thermal expansion coefficient close to that of the ceramic (usually alumina) used to construct the discharge chamber to reduce thermally induced stresses on the seals 28, 30.

The discharge chamber 12 is sealed at the ends of the body portion with seal members 28, 30. Seal members 28, 30 typically comprise a dysprosium-alumina silica glass and can be formed as a glass frit in the shape of a ring around one of the conductors, e.g. 18, and aligned vertically with the discharge chamber 12, and melted to flow down over the conductor 18 and form a seal between the conductor 18 and the body portion 22. The discharge chamber is then turned upside down to seal the other end of the body portion 22 after being filled with the dose.

The starting aid of the present invention is in the form of a conductive coating 24 bound to the body of the discharge tube 22. The conductive coating serves as a starting aid and extends substantially between the main electrodes 14, 16. Moreover, the conducting layer 24 provides a closer arc to further assist starting.

Figure 2:
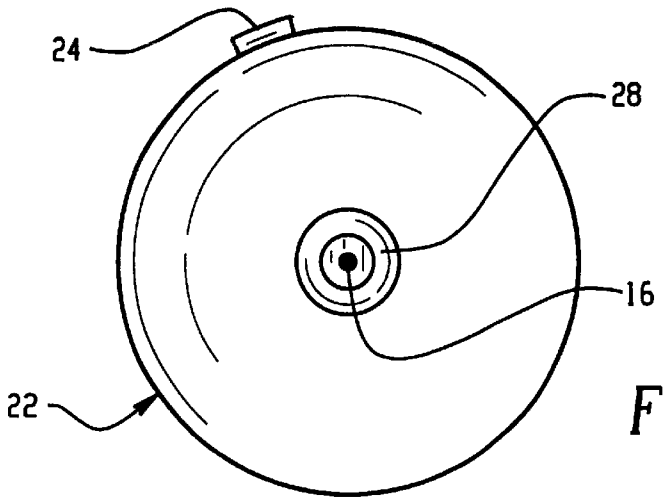
FIG. 2 illustrates a cross section of the discharge body 22 shown in FIG. 1.

With reference to FIG. 2, a cross section of the body of the discharge chamber 22 is shown. An electrode 16 is located near the end of the body 22, and the seal 28 is shown behind and around the electrode. The starting aid 24 is shown as a metal based coating 24 on the surface of the body 22.

The body of the discharge chamber 22 can be constructed by die pressing a mixture of ceramic powder and a binder into a solid cylinder. Typically, the mixture comprises about 95–98 weight % ceramic powder and about 2–5 weight % organic binder. The ceramic powder may comprise alumina, $Al_2O_3$ (having a purity of at least about 99.98%) in a surface area of about 2–10 meters$^2$ per gram. The alumina powder may be doped with magnesia to inhibit grain growth, for example, an amount equal to 0.03% to about 0.2%, preferably about 0.05% by weight of the alumina. Other ceramic materials which may be used include nonreactive refractory oxides and oxynitrides such as yttrium oxide, hafnium oxide, and solid solutions and components with alumina such as yttrium aluminum-garnet (YAG), aluminum oxynitride (AlON), and aluminum nitride (AlN). Binders which may be used individually or in combination of inorganic polymers are polyols, polyvinyl alcohol, vinylacetates, acrylates, cellulosics, and polyethers. Subsequent to die pressing, the binder is removed form the green part typically by a thermal-treatment, to form a bisque fired part. Thermal treatment may be conducted, for example, by heating the green part in air from room temperature to a maximum temperature, from about 980–1100° C. over 4 to 8 hours, then holding the maximum temperature for 1 to 5 hours, and then cooling the part. After thermal treatment, the porosity of the bisque fired part is typically about 40–50%.

While the invention has been described with reference to ceramic arc tubes, it should be noted that the present invention would be equally applicable to discharge lamps with quartz arc tubes as well as to both single crystal and polycrystalline alumina arc tubes.

Before or after the arc tube has been sintered, the conductive starting aid can be bound to the surface of the arc tube. The preferred starting aids of the present invention are metal based oxides, nitrides, carbides, and suicides. Examples of suitable starting aids may be selected from the group consisting of AlN, TiN, VN, NbN, CrN, ZrC, TaC, VC, NbC, TaC, $Cr_3C_2$, $Mo_2C$, WC, $Mo_5Si_3$, $MoSi_2$, $ZnO_2$, $TiO_2$, $Ti_2O_3$, and mixtures thereof The metal based oxides are preferably conducting materials, although a small amount of passive materials, such as non-conducting metal oxides, such as $Al_2O_3$ or $SiO_2$, may also be included, preferably less than 75%, most preferably less than 50% to aid in matching the thermal expansion coefficient of the coating to the thermal expansion coefficient of the arc tube.

The metal based coating is applied to the surface of the arc tube after the arc tube has been partially sintered. The coating may be applied via dipping, spraying, etc., in the form of particles (preferably in a carrier vehicle, such as an aqueous suspension), or may be sputter coated onto the surface of the arc tube. Preferably the coating will be a strip or a ring covering not more than about 3% of the surface area of the arc tube and have an average thickness between about 0.01 and 1,000 $\mu$m, more preferably between about 0.1 and 500 $\mu$m.

Lamps of the present invention contain conductive starting aids which are capable of surviving an air firing step for arc tube cleaning, such as temperatures exceeding 750° C. for several minutes, preferably more than 30 minutes, most preferably more than 60 minutes to remove organic surface contaminants. Preferably, the starting aids can survive thousands of hours preferably greater than 2000 hours, most preferably greater than 10,000 hours of operation in air.

The invention has been described with reference to the preferred embodiment. Obviously, modifications and alterations will occur to others upon reading and understanding the preceding, detailed description. It is intended that the invention be construed as including all such modifications and alterations insofar as they come within the scope of the appended claims or the equivalents thereof

We claim:

1. An arc discharge lamp comprising an arc tube including a starting aid, said starting aid comprising a coating on the surface of the arc tube, said coating comprised of metal oxide, nitride, carbide, silicide, and mixtures thereof.

2. The lamp of claim 1 wherein said coating is a conductive material.

3. The lamp of claim 1 further comprising passive material comprising nonconducting oxide components.

4. The lamp of claim 1 wherein the coating has a coefficient of thermal expansion substantially equivalent to the coefficient of thermal expansion of a material forming the arc tube.

5. The lamp of claim 1 wherein said arc tube is comprised of quartz.

6. The lamp of claim 1 wherein said arc tube is comprised of ceramic.

7. The lamp of claim 6 wherein said ceramic is alumina.

8. The lamp of claim 1 wherein said arc discharge lamp comprises a high pressure sodium lamp.

9. The lamp of claim 1 wherein said metal nitride is selected from TiN, ZrN, VN, NbN, CrN, and mixtures thereof.

10. The lamp of claim 1 wherein said metal oxide, carbide, and silicide is selected from TiC, VC, NbC, TaC, $Cr_3C_2$, $Mo_2C$, WC, $ZnO_2$, $TiO_2$, $Ti_2O_3$, $Mo_5Si_3$,$MoSi_2$ and mixtures thereof.

11. The lamp of claim 1 wherein said coating is in a pattern comprising lines extending substantially from a first electrode to a second electrode.

12. The lamp of claim 1 wherein said coating has a thickness between about 0.01 and 1000 $\mu$m.

13. A method for forming an arc discharge lamp comprising applying an external starting aid to the surface of an arc tube, said starting aid comprising a coating of metal oxide, nitride, carbide, silicide, and mixtures thereof.

14. The method of claim 13 wherein said coating is applied as particles of said metal oxide, nitride, carbide, or silicide in a carrier vehicle.

15. The method of claim 13 wherein said coating is applied by sputtering.

16. The method of claim 13 wherein said coating is applied by chemical vapor deposition.

17. The method of claim 13 wherein said coating is selected from the group consisting of AlN, TiN, VN, NbN, CrN, ZrC, VC, NbC, TaC, $Cr_3C_2$, $Mo_2C$, WC, $Mo_5Si_3$, $MoSi_2$, $ZnO_2$, $TiO_2$, $Ti_2O_3$, and mixtures thereof.

18. The method of claim 13 wherein said arc tube is partially sintered prior to applying said external starting aid.

19. The method of claim 13 wherein said external starting aid is deposited onto a fully dense arc tube.

20. A high pressure sodium lamp comprising an outer bulb; first and second discharge devices within said outer bulb connected electrically in series, each discharge device including a discharge vessel enclosing a discharge space and an ionizable filling; first and second discharge electrode assemblies within said discharge space each including an electrode portion on which a discharge arc terminates during normal lamp operation and a current conductor portion extending to the exterior of said discharge vessel; means for electrically connecting said first electrode assembly of each discharge device to a source of electric potential outside of said lamp envelope; and a starting aid comprising a coating on the surface of the arc tube, said coating comprised of metal oxide, nitride, carbide, silicide, and mixtures thereof.

* * * * *